US012054811B2

(12) United States Patent
Murase

(10) Patent No.: US 12,054,811 B2
(45) Date of Patent: Aug. 6, 2024

(54) ALUMINUM ALLOY MEMBER FOR FORMING FLUORIDE FILM AND ALUMINUM ALLOY MEMBER HAVING FLUORIDE FILM

(71) Applicant: SHOWA DENKO K.K., Tokyo (JP)

(72) Inventor: Isao Murase, Tochigi (JP)

(73) Assignee: SHOWA DENKO K.K., Tokyo (JP)

( * ) Notice: Subject to any disclaimer, the term of this patent is extended or adjusted under 35 U.S.C. 154(b) by 742 days.

(21) Appl. No.: 17/257,677

(22) PCT Filed: Apr. 19, 2019

(86) PCT No.: PCT/JP2019/016772
§ 371 (c)(1),
(2) Date: Jan. 4, 2021

(87) PCT Pub. No.: WO2020/008704
PCT Pub. Date: Jan. 9, 2020

(65) Prior Publication Data

US 2021/0317551 A1 Oct. 14, 2021

(30) Foreign Application Priority Data

Jul. 4, 2018 (JP) ..... 2018-127378
Dec. 7, 2018 (JP) ..... 2018-229556

(51) Int. Cl.
*C22C 21/06* (2006.01)
*C22F 1/05* (2006.01)
*C23C 28/04* (2006.01)

(52) U.S. Cl.
CPC ..... *C22C 21/06* (2013.01); *C22F 1/05* (2013.01); *C23C 28/04* (2013.01)

(58) Field of Classification Search
CPC ... C22C 21/06; C22F 1/05; C22F 1/06; C23C 28/04
See application file for complete search history.

(56) References Cited

FOREIGN PATENT DOCUMENTS

JP 8-92684 A 4/1996
JP 2003-119539 A 4/2003
(Continued)

OTHER PUBLICATIONS

English Abstract and English Machine Translation of Shigetoshi (JP 2003-119539) (Apr. 23, 2003).*
(Continued)

*Primary Examiner* — Jessee R Roe
(74) *Attorney, Agent, or Firm* — MILLEN, WHITE, ZELANO & BRANIGAN, P.C.; Ryan R. Pool

(57) ABSTRACT

Provided is an aluminum alloy member for forming a fluoride film thereon, the fluoride film being excellent in smoothness without occurrence of a black dot-shaped bulged portion and excellent in corrosion resistance against corrosive gas and plasma, etc. The aluminum alloy member for forming a fluoride film thereon 1 for use in a semiconductor producing apparatus consists of Si: 0.3 mass % to 0.8 mass %; Mg: 0.5 mass % to 5.0 mass %; Fe: 0.05 mass % to 0.5 mass %; Cu: 0 mass % or more and 0.5 mass % or less; Mn: 0 mass % or more and 0.30 mass % or less; Cr: 0 mass % or more and 0.30 mass % or less 0.5 mass % or less; and the balance being Al and inevitable impurities. When an average major diameter of a Fe-based crystallized product in the aluminum alloy member is D (μm), and an average crystalline particle diameter in the aluminum alloy member is Y (μm), a relation expression of $\log_{10} Y \leftarrow 0.320D+4.60$ is satisfied. A fluoride film 2 is formed on at least a part of a surface of the aluminum alloy member 1 for forming a fluoride film thereon.

2 Claims, 3 Drawing Sheets

(56) References Cited

FOREIGN PATENT DOCUMENTS

| | | | |
|---|---|---|---|
| JP | 3871544 | A | 10/2006 |
| WO | 96/15295 | A1 | 5/1996 |
| WO | 2015/060331 | A1 | 4/2015 |

OTHER PUBLICATIONS

International Search Report dated Jul. 23, 2019 issued in corresponding PCT/JP2019/016772 application (2 pages).
English Abstract of JP 2003-119539 A published Apr. 23, 2003.
English Abstract of JP 3871544 B2 published Oct. 27, 2006.
English Abstract of JP 8-92684 published Apr. 9, 1996.

* cited by examiner

ALUMINUM ALLOY MEMBER FOR FORMING FLUORIDE FILM AND ALUMINUM ALLOY MEMBER HAVING FLUORIDE FILM

TECHNICAL FIELD

The present invention relates to an aluminum alloy member for forming a fluoride film thereon for use as a member (component) of a semiconductor producing apparatus by forming a fluoride film on at least a part of a surface of an aluminum alloy member. It also related to an aluminum alloy member having a fluoride film for use as a member (component) of a semiconductor producing apparatus.

In this specification and claims, the term "fluoride film" means "a film containing at least fluoride" and does not mean only "a film made of only fluoride."

Further, in this specification and claims, the term "average crystalline particle diameter" means an average crystalline particle diameter measured by a cutting method (Heyn method) defined in JIS G0551.

BACKGROUND ART

As a member material for a chamber, a susceptor, a backing plate, etc., that constitutes a production apparatus for producing a semiconductor, an LCD, etc., a rolled material and a cast material made of an aluminum alloy, particularly an Al—Mg based JIS 5052 aluminum alloy and an Al—Si—Mg based JIS 6061 aluminum alloy, are often used. Further, since these production apparatuses are used at high temperatures and in corrosive gas atmospheres, such as, e.g., a silane ($SiH_4$) atmosphere, a fluorine-based gas atmosphere, and a chlorine-based halogen gas atmosphere, each member is subject to anodizing to form a hard anodic oxide coating on the surface thereof to improve the corrosion resistance.

However, even if such surface processing is performed, surface deterioration occurs early depending on the usage environment and the frequency of use, and it was necessary to update the surface treatment. In particular, in CVD and PVD treatment apparatuses, the usage temperature ranges from room temperature to about 400° C., and moreover, repetitive thermal stresses are applied, and therefore, cracking may occur due to the difference in thermal deformability between the base material and the anodic oxide coating. Further, during long-term use, even if there exists no remarkable damage, a workpiece comes into contact with the surface of the apparatus, causing abrasion of the anodic oxide coating when processing the workpiece.

Therefore, there has been proposed a vacuum chamber member excellent in gas resistance and plasma resistance in which a corrosion resistant protective film is formed on an Al-base material surface. The surface side of the corrosion resistant protective film is a layer mainly composed of aluminum oxide, or mainly composed of Al oxide and Al fluoride. The base material side of the corrosion resistant protective film is a layer mainly composed of Mg fluoride or a layer mainly composed of Mg fluoride and Al oxide (see Patent Document 1).

Further, an aluminum alloy material having excellent corrosion resistance is also known in which a fluorinated film, etc., is formed on the surface of an aluminum alloy base material consisting of Si: 0.2 to 1.0 wt %; Mg: 0.3 to 2.0 wt %, each content of Fe, Cu, Mn, Cr, Zn, and Ni as impurities being regulated to 0.1 wt % or less, the balance being Al and other impurities (see Patent Document 2).

These techniques intend to improve corrosion resistance by a fluorinated passivation film formed by subjecting an aluminum alloy base material to a fluorine treatment.

PRIOR ART DOCUMENT

Patent Document

Patent Document 1: Japanese Unexamined Patent Application Publication No. H11-061410

Patent Document 2: Japanese Unexamined Patent Application Publication No. 2003-119539

SUMMARY OF THE INVENTION

Problems to be Solved by the Invention

However, when an aluminum alloy base material is subjected to a fluorine treatment, there is a case that a black dot-shaped bulged portion is generated on the surface of the formed corrosion resistant film. When such a black dot-shaped bulged portion is generated, the heat absorption rate of the portion increases, so that the local temperature rise occurs during the use, for example, in a CVD apparatus, a PVD apparatus, or the like. When such a local temperature rise occurs, cracking occurs in the corrosion resistant film, causing peeling of the film, which in turn becomes impurity particles.

The present invention has been made in view of the above-described technical background, and aims to provide an aluminum alloy member for forming a fluoride film thereon, the aluminum alloy member capable of forming the fluoride film without causing a black dot-shaped bulged portion, the fluoride film being excellent in smoothness and excellent in corrosion resistance to corrosive gas and plasma. The present invention also aims to provide an aluminum alloy member with such a fluoride film.

Means for Solving the Problem

In order to investigate the causes of the generation of the black dot-shaped bulged portion, the inventor of the present invention performed a SEM-EDX mapping of the black dot-shaped bulged portion and its surrounding. The investigation revealed the following facts. That is, as shown in FIG. 5, in the normal portion 110, the magnesium fluoride layer 101 and the aluminum fluoride layer 102 are laminated in this order on the surface of the aluminum alloy base material 100 to form a corrosion resistant film. However, in the black dot-shaped bulged portion 111, there exists a portion (defective portion; divided portion) in which a magnesium fluoride layer is not locally formed on the surface of the aluminum alloy base material 100, and an aluminum fluoride 102 grew largely at the defective portion, thereby forming a bulged portion 111 of the aluminum fluoride. As a result of further diligent research in order to suppress the generation of the black dot-shaped bulged portion that grows by such a mechanism, the relationship between the average major diameter of the Fe-based crystallized product in the aluminum alloy member and the average crystalline particle diameter in the aluminum alloy member was found to be related to the generation of the black dot-shaped bulged portion. Thus, the inventor has completed the present invention. In other words, in order to achieve the above-described object, the present invention provides the following means.

[1] An aluminum alloy member for forming a fluoride film thereon, the aluminum alloy member consisting of:

Si: 0.3 mass % to 0.8 mass %;

Mg: 0.5 mass % to 5.0 mass %;

Fe: 0.05 mass % to 0.5 mass %;

Cu: 0 mass % or more and 0.5 mass % or less;

Mn: 0 mass % or more and 0.30 mass % or less;

Cr: 0 mass % or more and 0.30 mass % or less; and the balance being Al and inevitable impurities, wherein when an average major diameter of a Fe-based crystallized product in the aluminum alloy member is D (μm), and an average crystalline particle diameter in the aluminum alloy member is Y (μm), a following relational expression (1) is satisfied, $$\text{Log}_{10} Y \leq -0.320D+4.60 \quad \text{Expression (1), and}$$

wherein the aluminum alloy member is used as a member for a semiconductor producing apparatus.

[2] An aluminum alloy member having a fluoride film, comprising:

the aluminum alloy member for forming a fluoride film thereon as recited in the above-described Item [1]; and a fluoride film formed on at least a part of a surface of the aluminum alloy member.

[3] The aluminum alloy member having a fluoride film as recited in the above-described Item [2], wherein the fluoride film has a thickness of 0.1 μm to 10 μm.

[4] The aluminum alloy member having a fluoride film as recited in the above-described Item [2] or [3], wherein the fluoride film includes a first film layer formed on a surface of the aluminum alloy member for forming a fluoride film thereon and a second film layer formed on a surface of the first film layer, wherein the first film layer is a film containing magnesium fluoride, and wherein the second film layer is a film containing aluminum fluoride and aluminum oxide.

Effects of the Invention

In the invention as recited in the above-described Item [1], the aluminum alloy member has the above-described specific metal composition and is configured to satisfy the relational expression of the above-described expression (1). Therefore, when at least a portion of the surface of the aluminum alloy material for forming a fluoride film thereon is subject to a fluorine treatment to form a fluoride film, a black dot-shaped bulged portion (hereinafter, may simply be referred to as a "black dot portion") is not observed in the fluoride film, and the obtained aluminum alloy member with the fluoride film becomes excellent in corrosion resistance to corrosive gas, plasma, and the like.

In the invention as recited in the above-described Item [2], the aluminum alloy member has the above-described specific metal composition and is configured to satisfy the relational expression of the above-described expression (1). Therefore, it is possible to provide an aluminum alloy member having a fluoride film excellent in smoothness without a black dot portion and excellent in corrosion resistance to corrosive gas, plasma, or the like.

In the invention as recited in the above-described Item [3], since the thickness of the fluoride film is 0.1 μm or more, it is possible to further improve the corrosion resistance to corrosive gas, plasma, or the like. Further, since the thickness is 10 μm or less, it is possible to improve the productivity.

In the invention as recited in the above-described Item [4], since the fluoride film has a two-layer structure having the above-described specific configuration, corrosion resistance to corrosive gas, plasma, or the like can be further improved.

BRIEF DESCRIPTION OF THE DRAWINGS

In FIG. 4, the member plotted with ● (black circle) indicates that no black dot portion was observed at all, and the member plotted with ▲ indicates that a black dot portion occurred. In the graph of FIG. 4, the region on the lower left side of the oblique straight line of the solid line extending from the upper left to the lower right is a region represented by the expression (1). It is found that no black dot portion was observed at all in the member plotted in the region represented by the expression (1), while a black dot portion occurred in the member plotted in the region on the upper right side of the oblique straight line.

EMBODIMENTS FOR CARRYING OUT THE INVENTION

Figure 1:
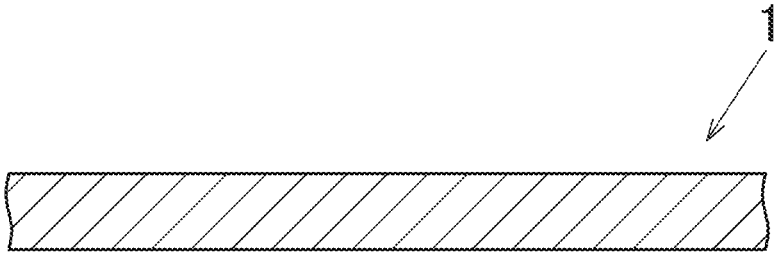
FIG. 1 is a cross-sectional view showing an embodiment of an aluminum alloy member for forming a fluoride film thereon according to the present invention.

The aluminum alloy member 1 for forming a fluoride film thereon according to the present invention, the aluminum alloy member 1 consists of Si: 0.3 mass % to 0.8 mass %, Mg: 0.5 mass % to 5.0 mass %, Fe: 0.05 mass % to 0.5 mass %, Cu: 0.5 mass % or less, Mn: 0.30 mass % or less, Cr: 0.30 mass % or less, and the balance being Al and inevitable impurities, wherein when an average major diameter of a Fe-based crystallized product in the aluminum alloy member is D (μm), and an average crystalline particle diameter in the aluminum alloy member is Y (μm), the following relational expression (1) is satisfied:

$$\text{Log}_{10} Y \leq 0.320D+4.60 \quad \text{Expression (1)}$$

The aluminum alloy member 1 for forming a fluoride film thereon according to the present invention is used as a member for a semiconductor producing apparatus.

The composition of the aluminum alloy according to the present invention (the limitation significance of the content rate range of each component) will be described below.

The Si (component) generates $Mg_2Si$ in the Al matrix to improve the strength of the aluminum alloy member. The Si content rate in the Aluminum alloy member is set to a range from 0.3 mass % to 0.8 mass %. When the Si content rate is less than 0.3 mass %, $Mg_2Si$ is less generated, which cannot exhibit the effect of improving the strength. On the other hand, when the Si content rate exceeds 0.8 mass %, a crystallized product of Si alone is formed. However, such a Si alone produces $SiF_4$ and sublimates, which prevents the formation of a uniform fluoride film on the surface of the aluminum alloy member. In order to prevent the formation of the crystalized product of the Si alone, the Si content rate is regulated to 0.8 mass % or less. Above all, the Si content rate in the aluminum alloy member is preferably in the range of 0.35 mass % to 0.6 mass %.

The Mg (component) generates $Mg_2Si$ in the Al matrix to improve the strength of the Aluminum alloy member. Mg reacts with F to form a dense magnesium fluoride ($MgF_2$) layer on the surface of an aluminum alloy member. The Mg content rate in the aluminum alloy member ranges from 0.5 mass % to 5.0 mass %. When the Mg content rate is less than 0.5 mass %, a dense magnesium fluoride ($MgF_2$) layer cannot be formed. On the other hand, when the Mg content rate exceeds 5.0 mass %, the workability of the alloy material deteriorates. Above all, the Mg content rate in the aluminum alloy member is preferably in the range of 1.0 mass % to 2.5 mass %.

When the Cu (component) is added, the effects of uniformly dispersing the $Mg_2Si$ in the Al matrix can be exerted, which can improve the strength of the aluminum alloy member. In addition, since the $Mg_2Si$ can be uniformly dispersed, a uniform magnesium fluoride ($MgF_2$) layer can be formed on the surface of the aluminum alloy member. The Cu content rate in the aluminum alloy member is set to 0% or more and 0.5 mass % or less. When the Cu content rate exceeds 0.5 mass %, a Cu-based crystallized product is generated, which hinders the formation of a fluoride layer (fluoride film). Above all, the Cu content rate in the aluminum alloy member is preferably in the range of 0.1 mass % to 0.3 mass %.

The Fe (component) generates a Fe-based crystallized product in the Al matrix. When a coarse crystallized product is present on the surface of the aluminum alloy member, this crystallized product inhibits the diffusion of Mg to the surface, and the dense layer of magnesium fluoride is not generated at the location where the crystallized product is present. As a result, aluminum fluoride largely grows at the location where a magnesium fluoride layer is not produced, causing a bulged portion (i.e., black dot portion) of aluminum fluoride. In order to prevent the formation of such a black dot portion, the Fe content rate needs to be 0.5 mass % or less. Further, when the Fe content rate exceeds 0.5 mass %, the size of the Fe-based crystallized product generated by the casting process becomes too large, which hinders miniaturization by plastic working, such as, e.g., rolling and forging, in the subsequent process. On the other hand, when the Fe content rate is less than 0.05 mass %, casting cracking or the like occurs. Therefore, the Fe content rate in the aluminum alloy member is set to fall within the range of 0.05 mass % to 0.5 mass %. Above all, the Fe content rate in the aluminum alloy member is preferably in the range of 0.08 mass % to 0.15 mass %.

The content rate of each of Mn (component) and Cr (component) is set to 0% or more and 0.30 mass % or less. When it exceeds 0.30 mass %, a coarse crystallized product is produced. An alloy composition containing neither Mn nor Cr (i.e., a composition in which the content rate is 0%) may be used, or an alloy composition containing Mn in the range of 0.30 mass % or less and not containing Cr may be used. Alternatively, an alloy composition containing Cr in the amount of 0.30 mass % or less and not containing Mn may be used. Above all, the content rate of Mn (component) and Cr (component) are both preferably set to 0% or more and 0.10 mass % or less.

In the aluminum alloy member 1 for forming a fluoride film thereon according to the present invention, when the average major diameter of the Fe-based crystallized product in the aluminum alloy member is D (μm), and the average crystalline particle diameter in the aluminum alloy member is Y (μm), the configuration satisfies the following relational expression (1):

$$\text{Log}_{10} Y \leftarrow 0.320D+4.60 \qquad \text{Expression (1)}$$

Figure 4:
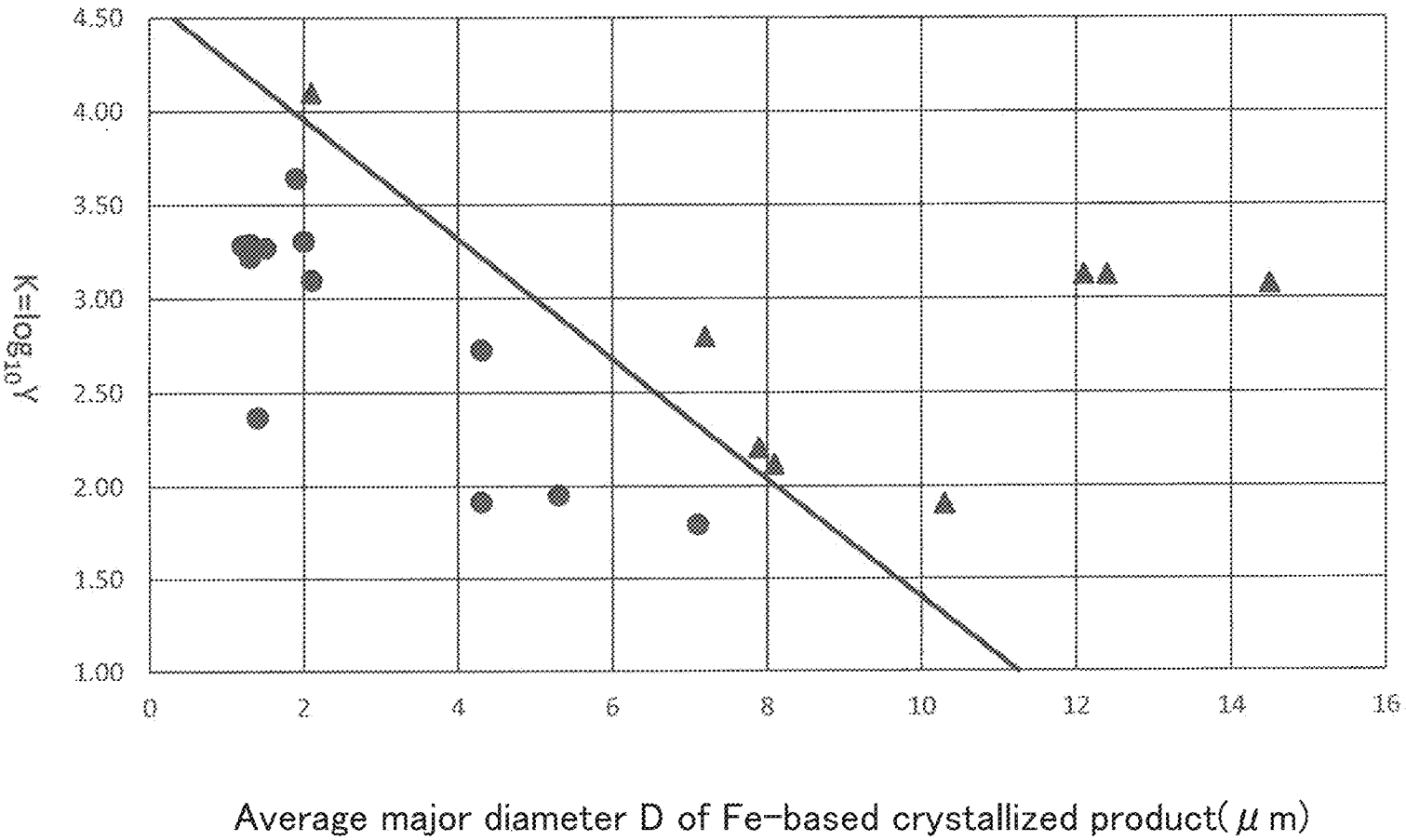
FIG. 4 is a graph in which the common logarithm (K) of the average crystalline particle diameter (Y) is plotted on the vertical axis, and the average major diameter (D) of the Fe-based crystallized product is plotted on the horizontal axis.

FIG. 4 is a graph in which the common logarithm (K) of the average crystalline particle diameter (Y) is plotted on the vertical axis, and the average major diameter (D) of the Fe-based crystallized product is plotted on the horizontal axis. In order to form a magnesium fluoride layer, Mg inside the aluminum alloy need to diffuse to the surface. The diffusion rate of Mg is higher in the crystal grain boundary than in the crystal grain. The smaller crystal grain increases the area of the grain boundary, which facilitates the diffusion of Mg to the surface. Therefore, even if the size of the crystallized product increases, it is possible to generate a magnesium fluoride layer.

That is, in the aluminum alloy member 1 for forming a fluoride film thereon of the present invention in which the composition of the aluminum alloy satisfies the condition of the content rate range of each above-described component and the relational expression of the above-described expression (1), no black dot portion (no black dot-shaped bulged portion) is generated in the fluoride film when it is treated with fluoride to form a fluoride film. Therefore, the smoothness is excellent (the above-described local temperature increase does not occur). The aluminum alloy member 10 having the fluoride film 2 obtained as described above has excellent corrosion resistance to corrosive gas, plasma, and the like, due to the presence of the fluoride film.

Figure 5:
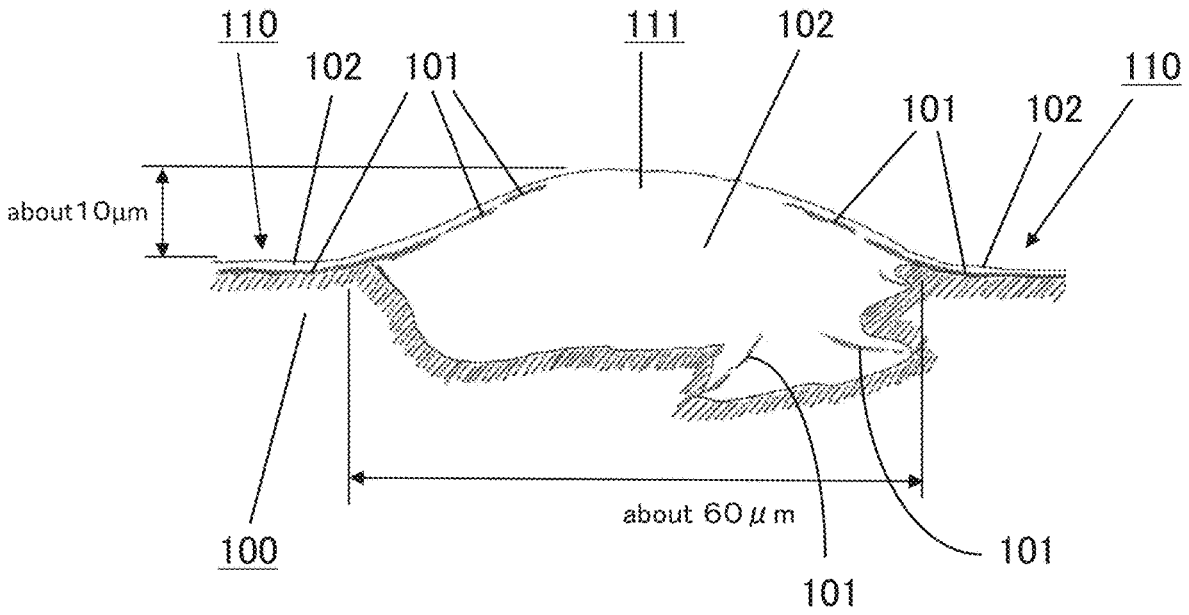
FIG. 5 is an explanatory drawing (schematic cross-sectional view) of the occurrence of a black dot portion.

On the other hand, in the region on the upper right side of the oblique straight line of the solid line extending from the upper left to the lower right in FIG. 4 (the region that does not satisfy the expression (1)), the size of the Fe-based crystallized product becomes too large, and the Fe-based crystallized product inhibits the diffusion of Mg. As a result, as shown in FIG. 5, the magnesium fluoride layer 101 is not partially generated, and the aluminum fluoride 102 greatly grows in the defective portion in which the magnesium fluoride layer is not generated, generating a black dot portion (black dot-shaped bulged portion).

Further, even when the composition of the aluminum alloy satisfies the condition of the content rate range of each of the components described above, in the aluminum alloy member having a configuration that does not satisfy the relational expression of the above expression (1), a black dot portion (black dot-shaped bulged portion) is generated on the fluoride film when the member is treated with fluoride to form a fluoride film. When such a black dot portion is generated, for example, when used as a member of a semiconductor producing apparatus (a CVD apparatus, a PVD apparatus, a dry etching apparatus, a vacuum evaporation apparatus, etc.), the heat absorption rate of the portion increases, resulting in a local temperature rise. As a result, cracking occurs in the fluoride film, resulting in the peeling of the film, which in turn causes a problem that the peeled film becomes impurity particles.

Figure 3:
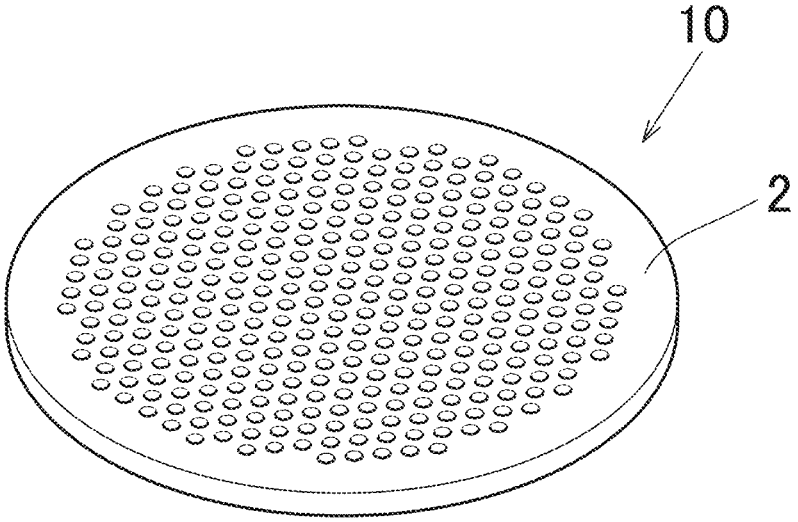
FIG. 3 is a perspective view showing a shower head which is one example of an aluminum alloy member having a fluoride film according to the present invention.

The aluminum alloy member 10 having a fluoride film according to the present invention is used as a member (component) of a semiconductor producing apparatus (a CVD apparatus, a PVD apparatus, a dry etching apparatus, a vacuum evaporation apparatus, or the like). The component is not particularly limited, but examples thereof include a shower head (see FIG. 3), a vacuum chamber, a susceptor, and a backing plate. The shower head 10 is formed as an aluminum alloy member 10 having a fluoride film 2 in a disk shape, and a large number of pores penetrating in the thickness direction thereof is formed.

Next, an example of the production method of the aluminum alloy member for forming a fluoride film 1 thereon and an aluminum alloy member 10 having a fluoride film will be collectively described.

(Casting Process)

After obtaining an aluminum alloy molten metal prepared to have a composition consisting of Si: 0.3 mass % to 0.8 mass %, Mg: 0.5 mass % to 5.0 mass %, Fe: 0.05 mass % to 0.5 mass %, Cu: 0 mass % or more and 0.5 mass % or less; Mn: 0 mass % or more and 0.30 mass % or less; Cr: 0 mass % or more and 0.30 mass % or less, and the balance being Al and inevitable impurities, the aluminum alloy molten metal is subjected to a casting process to obtain a casting (a cast plate material, a billet, etc.). The casting method is not particularly limited, and conventionally known methods may be used. For example, a continuous casting and rolling method, a hot-top casting method, a float casting method, a semi-continuous casting method (DC casting method) and the like can be exemplified.

(Homogenization Heat Treatment Process)

A homogenization heat treatment is performed on the obtained casting. That is, it is preferable to perform a homogenization heat treatment in which the casting is maintained at a temperature between 450° C. and 580° C. for 5 hours to 10 hours. When it is less than 450° C., the softening of the ingot becomes insufficient, increasing the pressures at the time of hot working, which in turn deteriorates the appearance quality and also deteriorates the productivity, which is therefore not preferable. On the other hand, when the temperature exceeds 580° C., local dissolution occurs inside the ingot, which is not preferable.

(Hot Working Process)

The ingot is subjected to hot working. The hot working is not particularly limited and for example is exemplified by a rolling process, an extrusion process, a forging process, and the like. The heating temperature at the time of the rolling process is preferably set to 450° C. to 550° C. In addition, it is preferable to set the heating temperature at 450° C. to 550° C. at the time of the extruding process. The heating temperature at the time of the forging process is preferably set to 450° C. to 550° C.

(Solution Heat Treatment Process)

Next, the worked product (a rolled product, an extruded product, and the like) obtained by the hot working is heated and subjected to a solution heat treatment. It is preferable that the solution heat treatment is performed at a temperature of 520° C. to 550° C. for 2 hours to 6 hours.

(Aging Treatment Process)

Next, the worked product (a rolled product, an extruded product, and the like) after the solution heat treatment is then heated at a temperature of 170° C. to 210° C. for 5 hours to 11 hours to perform an aging treatment.

The aluminum alloy member 1 for forming a fluoride film thereon is obtained through the casting process, the homogenization heat treatment process, the hot working process, the solution heat treatment process, and the aging treatment process as described above.

(Anodizing Process)

By subjecting the aluminum alloy member 1 for forming a fluoride film thereon to anodizing after the aging treatment, an anodic oxide coating is formed on the surface of the aluminum alloy member. The electrolyte for anodizing is not particularly limited, and examples thereof include a sulfuric aqueous solution and the like. It is also preferable to perform the anodizing by controlling the temperature of the electrolyzer (electrolyte) between 10° C. and 40° C. The voltages at the time of anodizing are not particularly limited, but is preferably set in the range of 10 V to 100 V. The anodizing time is preferably set to 1 minute to 60 minutes.

(Fluorine Treatment Process)

Next, a fluorine treatment is performed on the aluminum alloy member after the formation of the anodic oxide coating. For example, by setting the aluminum alloy member after forming the anodic oxide coating in a chamber and vacuuming the inside of the chamber, a gas containing a fluorine gas is introduced into the chamber and heating is performed in this fluoride gas atmosphere to thereby form the fluoride film 2 on the surface of the aluminum alloy member. The heating temperature in the fluorine gas atmosphere is preferably set at 250° C. to 350° C. In this way, the aluminum alloy member 10 having the above-described fluoride film is obtained. Alternatively, for example, in cases where the application is a part of a vacuum chamber component, after starting to use the aluminum alloy member as a vacuum chamber, a fluorine gas is used to clean the inside of the vacuum chamber. However, a manufacturing method may be adopted in which a fluoride film is reproduced on the surface of the aluminum alloy member and formed thicker each time it is cleaned using this fluorine gas. Alternatively, for example, in a state in which the aluminum alloy member formed into a shower head shape is set in a semiconductor production apparatus, it can be heated in the fluorine gas atmosphere to form a fluoride film 2, or plasma can be used to form the fluoride film 2, and after forming the fluoride film in this way, the semiconductor production may proceed as it is.

The above-described production method is only an example, and the aluminum alloy member 1 for forming a fluoride film thereon according to the present invention and the aluminum alloy member 10 having the fluoride film according to the present invention are not limited to be obtained by the above-described production method.

EXAMPLES

Next, specific examples of the present invention will be described, but the present invention is not particularly limited to those examples.

Example 1

After obtaining an aluminum alloy molten metal by heating an aluminum alloy consisting of Si: 0.50 mass %, Mg: 1.15 mass %, Cu: 0.20 mass %, Fe: 0.07 mass %, Mn: 0.02 mass %, Cr: 0.05 mass %, the balance being Al and inevitable impurities, an aluminum alloy molten metal was formed in a plate-shaped ingot having a thickness of 200 mm by a DC casting method by using the aluminum alloy molten metal.

Next, the plate-shaped ingot was subjected to a homogenization heat treatment at 470° C. for 7 hours. Then, after cutting the ingot to a predetermined size, hot rolling was performed at 500° C. and then subjected to cold rolling at room temperature to obtain an aluminum alloy plate having a thickness of 4 mm. Next, after cutting to a size of 50 mm in length×50 mm in width, the aluminum alloy plate was heated at 530° C. for 4 hours to perform a solution heat treatment, and then heated at 180° C. for 8 hours to perform an aging treatment. Thus, the aluminum alloy member 1 for forming a fluoride film thereon shown in FIG. 1 was obtained.

Next, for the aluminum alloy plate (aluminum alloy member for forming a fluoride film thereon) after the aging treatment, anodizing was performed at a voltage of 20 V for 2 minutes using a sulfuric acid aqueous solution having a density of 15 mass % as an electrolyte and controlling the temperature of the electrolyzer (electrolyte) to 25° C. to form an anodized oxide coating having a thickness of 2 μm on the entirety of the surface of the aluminum alloy plate.

Figure 2:
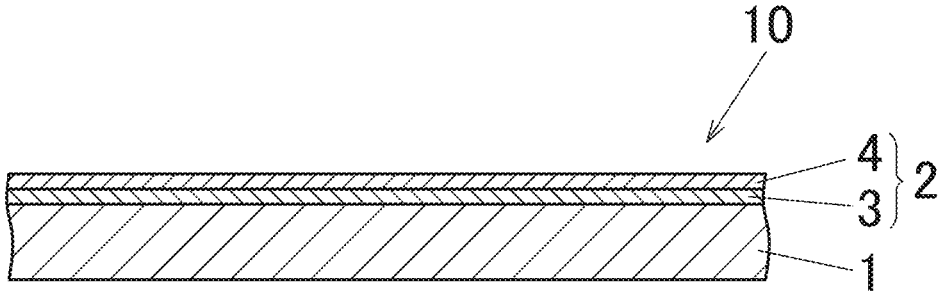
FIG. 2 is a cross-sectional view showing an embodiment of an aluminum alloy member having a fluoride film according to the present invention.

Next, after the aluminum alloy plate after forming the anodic oxide coating was set in the chamber and the inside of the chamber was vacuumed, a fluoride-containing inert gas was introduced into the chamber and kept at 260° C. for 24 hours in this state, thereby forming a fluoride film 2 having a thickness of 2 μm. That is, an aluminum alloy member 10 having a fluoride film as shown in FIG. 2 was obtained.

In the obtained aluminum alloy member 10 having a fluoride film, the fluoride film 2 had a configuration composed of: a first film layer 3 containing magnesium fluoride having a thickness of 0.5 μm formed on the surface of the aluminum alloy member 1 for forming a fluoride film thereon; and a second film layer (film layer containing aluminum fluoride and aluminum oxide) having a thickness of 1.5 μm formed on the surface of the first film layer 3.

Examples 2 to 7, 11, and 12

As an aluminum alloy for forming an aluminum alloy molten metal, an aluminum alloy member 1 for forming a fluoride film thereon was obtained in the same manner as in Example 1 except that an aluminum alloy having the alloy composition as shown in FIG. 1 (aluminum alloy consisting of: Si, Mg, Cu, Fe, Mn, Cr, and the balance being Al and inevitable impurities at the ratio shown in Table 1) was used. Then, an aluminum alloy member 10 having a fluoride film 2 shown in FIG. 2 was obtained in the same manner as in Example 1.

Examples 8 to 10

As an aluminum alloy for forming an aluminum alloy molten metal, the aluminum alloy member 1 for forming a fluoride film thereon as shown in FIG. 1 was obtained in the same manner as in Example 1 except that an aluminum alloy having the alloy composition as shown in Table 1 (aluminum alloy consisting of Si, Mg, Cu, Fe, Mn, Cr in the ratio shown in Table 1, respectively, the balance being Al and inevitable impurities) was used and the rolling reduction was set at 99% instead of 77% during the hot rolling. Then, an aluminum alloy member 10 having a fluoride film 2 as shown in FIG. 2 was obtained in the same manner as in Example 1.

Comparative Examples 1 to 3, and 7 to 10

As an aluminum alloy for forming an aluminum alloy molten metal, an aluminum alloy member 1 for forming a fluoride film thereon as shown in FIG. 1 was obtained in the same manner as in Example 1 except that an aluminum alloy having the alloy composition as shown in Table 1 (aluminum alloy consisting of Si, Mg, Cu, Fe, Mn, Cr in the ratio shown in Table 1, respectively, and the balance being Al and inevitable impurities). Then, an aluminum alloy member 10 having a fluoride film 2 as shown in FIG. 2 was obtained in the same manner as in Example 1.

Comparative Examples 4 to 6

As an aluminum alloy for forming an aluminum alloy molten metal, an aluminum alloy member 1 for forming a fluoride film thereon as shown in FIG. 1 was obtained in the same manner as in Example 1 except that an aluminum alloy having the alloy composition as shown in Table 1 (aluminum alloy consisting of Si, Mg, Cu, Fe, Mn, Cr in the ratio shown in Table 1, respectively, and the balance being Al and inevitable impurities) was used, the rolling reduction was set to 99% instead of 77% during the hot rolling. Then, an aluminum alloy member 10 having a fluoride film 2 as shown in FIG. 2 were obtained in the same manner as in Example 1.

Comparative Examples 4 to 6

For the aluminum alloy member for forming a fluoride film thereon of each of Examples and Comparative Examples obtained as described above, the "average crystalline particle diameter (Y)" and the "average major diameter of Fe-based crystallized product (D)" was obtained by the following measuring method.

<Measuring Method of Average Crystal Grain Size>

The surface of the aluminum alloy member for forming a fluoride film thereon was buffed and then etched by a Barker method. After water washing and drying, the etching processed surface was observed with an optical microscope, and the "average crystalline particle diameter (Y)" was measured by a cutting method. The results are shown in Table 1.

<Method of Measuring Average Major Axis of Fe-Based Crystallized Product>

After buffing the surface of the aluminum alloy member for forming a fluoride film thereon, an SEM (Scanning Electron Microscope) observation was made to extract crystallized products that looked white in the reflected electronic image, and the absolute maximum lengths of these extracted crystallized products were measured with an image analysis apparatus. The average major diameter (D) of the Fe-based crystallized product is the mean value of 100 data selected from crystallized products with larger absolute maximum lengths by excluding those with circle equivalent diameters of 0.3 μm or less from the crystallized products arbitrary extracted from a rectangular field-of-view area of 315 μm×215 μm. The results are set forth in Table 1.

TABLE 1

| Rolling Reduction | Aluminum alloy composition (mass %) | | | | | | Presence or absence of Si | Average crystal grain diameter | |
|---|---|---|---|---|---|---|---|---|---|
| (%) | Si | Mg | Cu | Fe | Mn | Cr | precipitation | Y (μm) | $K = \log_{10}Y$ |
| 77 | 0.50 | 1.15 | 0.20 | 0.07 | 0.02 | 0.05 | Absence | 1916 | 3.2824 |
| 77 | 0.75 | 1.15 | 0.20 | 0.10 | 0.03 | 0.05 | Absence | 1850 | 3.2672 |
| 77 | 0.30 | 1.15 | 0.20 | 0.10 | 0.03 | 0.05 | Absence | 1654 | 3.2185 |
| 77 | 0.50 | 0.50 | 0.20 | 0.09 | 0.04 | 0.06 | Absence | 1949 | 3.2898 |
| 77 | 0.50 | 5.00 | 0.20 | 0.09 | 0.04 | 0.06 | Absence | 234 | 2.3692 |

TABLE 1-continued

| | | | | | | | | | |
|---|---|---|---|---|---|---|---|---|---|
| 77 | 0.49 | 1.16 | 0.05 | 0.10 | 0.03 | 0.05 | Absence | 1250 | 3.0969 |
| 77 | 0.49 | 1.16 | 0.45 | 0.10 | 0.03 | 0.05 | Absence | 532 | 2.7259 |
| 99 | 0.50 | 1.14 | 0.19 | 0.48 | 0.02 | 0.05 | Absence | 62 | 1.7924 |
| 99 | 0.50 | 1.15 | 0.19 | 0.09 | 0.25 | 0.04 | Absence | 89 | 1.9494 |
| 99 | 0.51 | 1.15 | 0.20 | 0.11 | 0.02 | 0.26 | Absence | 82 | 1.9138 |
| 77 | 0.51 | 1.17 | 0.19 | 0.09 | 0.03 | 0.09 | Absence | 4365 | 3.6400 |
| 77 | 0.50 | 1.16 | 0.01 | 0.09 | 0.02 | 0.05 | Absence | 2012 | 3.3036 |
| 77 | 0.85 | 1.15 | 0.20 | 0.10 | 0.03 | 0.05 | Presence | 1860 | 3.2695 |
| 77 | 0.50 | 0.40 | 0.20 | 0.09 | 0.04 | 0.06 | Absence | 1890 | 3.2765 |
| 77 | 0.49 | 1.16 | 0.60 | 0.10 | 0.03 | 0.05 | Absence | 624 | 2.7952 |
| 99 | 0.50 | 1.15 | 0.20 | 0.55 | 0.02 | 0.05 | Absence | 80 | 1.9031 |
| 99 | 0.50 | 1.15 | 0.19 | 0.09 | 0.35 | 0.04 | Absence | 130 | 2.1139 |
| 99 | 0.51 | 1.15 | 0.20 | 0.11 | 0.02 | 0.35 | Absence | 160 | 2.2041 |
| 77 | 0.50 | 1.14 | 0.19 | 0.48 | 0.02 | 0.05 | Absence | 1186 | 3.0741 |
| 77 | 0.50 | 1.15 | 0.19 | 0.09 | 0.25 | 0.04 | Absence | 1329 | 3.1235 |
| 77 | 0.51 | 1.15 | 0.20 | 0.11 | 0.02 | 0.26 | Absence | 1321 | 3.1209 |
| 77 | 0.54 | 1.14 | 0.19 | 0.12 | 0.03 | 0.13 | Absence | 12480 | 4.0962 |
| | Ex. 1 | Ex. 2 | Ex. 3 | Ex. 4 | Ex. 5 | Ex. 6 | Ex. 7 | Ex. 8 | Ex. 9 |

| Rolling Reduction (%) | Average major diameter D of Fe-based crystalized product | Right side calculation value M of inequality expression (1) | Magnitude correlation of K and M | Whether or not Expression (1) is Satisfied | Evaluation of presence or absence of black point ○: Absence X: Presence |
|---|---|---|---|---|---|
| 77 | 1.2 | 4.216 | K < M | Satisfied | ○ |
| 77 | 1.5 | 4.12 | K < M | Satisfied | ○ |
| 77 | 1.3 | 4.184 | K < M | Satisfied | ○ |
| 77 | 1.3 | 4.184 | K < M | Satisfied | ○ |
| 77 | 1.4 | 4.152 | K < M | Satisfied | ○ |
| 77 | 2.1 | 3.928 | K < M | Satisfied | ○ |
| 77 | 4.3 | 3.224 | K < M | Satisfied | ○ |
| 99 | 7.1 | 2.328 | K < M | Satisfied | ○ |
| 99 | 5.3 | 2.904 | K < M | Satisfied | ○ |
| 99 | 4.3 | 3.224 | K < M | Satisfied | ○ |
| 77 | 1.9 | 3.992 | K < M | Satisfied | ○ |
| 77 | 2.0 | 3.690 | K < M | Satisfied | ○ |
| 77 | 1.8 | 4.024 | K < M | Satisfied | X |
| 77 | 1.4 | 4.152 | K < M | Satisfied | X |
| 77 | 7.2 | 2.296 | K > M | Not satisfied | X |
| 99 | 10.3 | 1.304 | K > M | Not satisfied | X |
| 99 | 8.1 | 2.008 | K > M | Not satisfied | X |
| 99 | 7.9 | 2.072 | K > M | Not satisfied | X |
| 77 | 14.5 | −0.04 | K > M | Not satisfied | X |
| 77 | 12.1 | 0.728 | K > M | Not satisfied | X |
| 77 | 12.4 | 0.632 | K > M | Not satisfied | X |
| 77 | 2.1 | 3.928 | K > M | Not satisfied | X |
| | Ex. 10 | Ex. 11 | Ex. 12 | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |

For the aluminum alloy member having a fluoride film of each Example and Each comparative example obtained as described above, the presence or absence of a black dot portion (black dot-shaped bulged portion) in the fluoride film was examined using a 25× microscope based on the following evaluating method and evaluated based on the following criteria. The results are shown in Table 1.

(Criteria)

"○": No black dot portion is observed (not present)

"Δ": Black dot portion is slightly observed

"×": Black dot portion is present noticeably

As is apparent from Table 1, the aluminum alloy material having the fluoride film according to the present invention obtained by using the aluminum alloy member for a forming fluoride film thereon of Examples 1 to 12 of the present invention showed no black dot portion in the fluoride film.

In contrast, in Comparative Examples 1 to 10, black dot portions were noticeably seen in the fluoride film. In Comparative Examples 7 to 10, black dot portions were remarkably present because the alloy composition satisfied the specified range of the present invention, but the expression (1) was not satisfied.

INDUSTRIAL APPLICABILITY

The aluminum alloy member 1 for forming a fluoride film thereon according to the present invention is used as a member (component) of a semiconductor producing apparatus (a CVD apparatus, a PVD apparatus, a dry etching apparatus, a vacuum evaporation apparatus, or the like) in which at least a part of a surface is subjected to a fluorine treatment to form a fluoride film.

The aluminum alloy member 10 having a fluoride film according to the present invention is used as a member (component) of a semiconductor producing apparatus (a CVD apparatus, a PVD apparatus, a dry etching apparatus, a vacuum evaporation apparatus, or the like).

The component is not particularly limited, but examples thereof include a shower head (see FIG. 3), a vacuum chamber, a susceptor, and a backing plate.

This application claims priority to Japanese Patent Application No. 2018-127378 filed on Jul. 4, 2018 and Japanese Patent Application No. 2018-229556 filed on Dec. 7, 2018, the disclosures of which are incorporated herein by reference in their entirety.

The terms and descriptions used herein are used to describe embodiments according to the present invention, and the present invention is not limited thereto. The present invention is intended to allow for any design modifications within the scope of the claims without departing from the spirit thereof.

DESCRIPTION OF SYMBOLS

1: aluminum alloy member for forming a fluoride film thereon
2: fluoride film
3: first film layer
4: second film layer
10: aluminum alloy member with a fluoride film

The invention claimed is:

1. An Aluminum alloy member for forming a fluoride film thereon, the aluminum alloy member consisting of:

Si: 0.3 mass % to 0.8 mass %;
Mg: 0.5 mass % to 5.0 mass %;
Fe: 0.05 mass % to 0.5 mass %;
Cu: 0 mass % or more and 0.5 mass % or less;
Mn: 0 mass % or more and 0.30 mass % or less;
Cr: 0 mass % or more and 0.30 mass % or less; and
the balance being Al and inevitable impurities, wherein when an average major diameter of a Fe-based crystallized product in the aluminum alloy member is D (μm) and an average crystalline particle diameter in the aluminum alloy member is Y (μm), a following relational expression (1) is satisfied, $Log_{10}Y \leftarrow -0.320D+4.60$ . . . Expression (1), and wherein the aluminum alloy member is for use as a member for a semiconductor producing apparatus, and wherein the aluminum alloy member further comprises a fluoride film formed on at least a part of a surface of the aluminum alloy member, wherein the fluoride film includes a first film layer formed on a surface of the aluminum alloy member for forming a fluoride film thereon and a second film layer formed on a surface of the first film layer, wherein the first film layer is a film containing magnesium fluoride, and wherein the second film layer is a film containing aluminum fluoride and aluminum oxide.

2. The Aluminum alloy member having a fluoride film as recited in claim 1, wherein the fluoride film has a thickness of 0.1 μm to 10 μm.

* * * * *